US005446926A

United States Patent [19]

Bourque et al.

[11] Patent Number: 5,446,926

[45] Date of Patent: Sep. 5, 1995

[54] FASTENER FOR SECURING A SOFT LINING TO A HARD SHELL

[75] Inventors: René Bourque; Rodrigue McDuff, both of Laval; Daniel Chartrand, Deux-Montagnes, all of Canada

[73] Assignee: Canstar Sports Group Inc., Ville Mont Royal, Canada

[21] Appl. No.: 159,135

[22] Filed: Nov. 30, 1993

[30] Foreign Application Priority Data

Dec. 8, 1992 [CA] Canada ..... 2084828

[51] Int. Cl.[6] ..... A41D 13/00

[52] U.S. Cl. ..... 2/22; 2/2; 411/509; 24/453

[58] Field of Search ..... 2/22, 16, 24, 2; 411/508, 509, 510, 913, 907, 908; 602/12, 16, 20, 23, 26; 24/459, 453, 618, 107; 29/525.1, 453, 464; 428/34.1

[56] References Cited

U.S. PATENT DOCUMENTS 3,772,704 11/1973 Carbonneau ..... 2/22

4,818,824 4/1989 Dixit et al. ..... 411/907 X

*Primary Examiner*—Clifford D. Crowder

*Assistant Examiner*—Paul C. Lewis

*Attorney, Agent, or Firm*—R. Craig Armstrong

[57] ABSTRACT

A fastener for securing a hard shell and a soft lining together, with particular utility for protective sports gear, is described. The fastener has a broad flexible base portion, a bell-shaped portion leading from the base portion to a shoulder portion, and a post projecting from the shoulder portion and having an annular flange extending therefrom. The shell is trapped between the shoulder portion and the annular flange, and the lining is trapped between the hard shell and the base portion.

2 Claims, 2 Drawing Sheets

FASTENER FOR SECURING A SOFT LINING TO A HARD SHELL

BACKGROUND OF THE INVENTION

FIELD OF THE INVENTION

This invention relates to fasteners for use in securing various elements of sports equipment together, especially a soft lining or pad to a hard shell.

DESCRIPTION OF THE PRIOR ART

Many pieces of sport equipment involve a soft lining or pad which must have a hard shell secured to it. For example, shin pads for use in ice hockey conventionally have a flexible elongated lining of felt, foam or sewn cushioning material which may be arranged to wrap partially around the front of a player's lower leg, from the ankle to just above the knee. Rigid or semi-rigid plastic shin and knee shields, of polyethylene for example, are secured to the outside of the pad.

The shield members are conventionally sewn or riveted to the lining. For example, it is common to sew the knee shield to the lining, and to rivet tile shin shield to the lining with large rivets in several spaced-apart locations. These operations are labor intensive, and add to the cost of producing the shin pad. Furthermore, a rivet or the like results in the exposure of a hard surface to the player's leg, unless the rivet is covered over by additional padding, which adds further to the labor component and to the material cost. Having something hard exposed to the player obviously defeats the purpose of having a padded lining, and may cause or fail to prevent injury during an impact.

Many pieces of protective gear for sports require such fastening of a hard shell to a soft lining. A shin pad is just one example of equipment where there is such a requirement.

SUMMARY OF THE INVENTION

In view of the above, it is an object of the invention to provide a fastener for securing a soft lining to a hard shell in an effective and inexpensive manner.

In the invention, the fastener is of a flexible rubber or plastic composition, and has a broad flexible base portion, a bell-shaped portion leading from the base portion to a shoulder portion, and a post projecting from the shoulder portion and having an annular flange extending therefrom. The hard shell is trapped between the shoulder portion and the annular flange. The soft lining is trapped between the broad base portion and the hard shell.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 4:
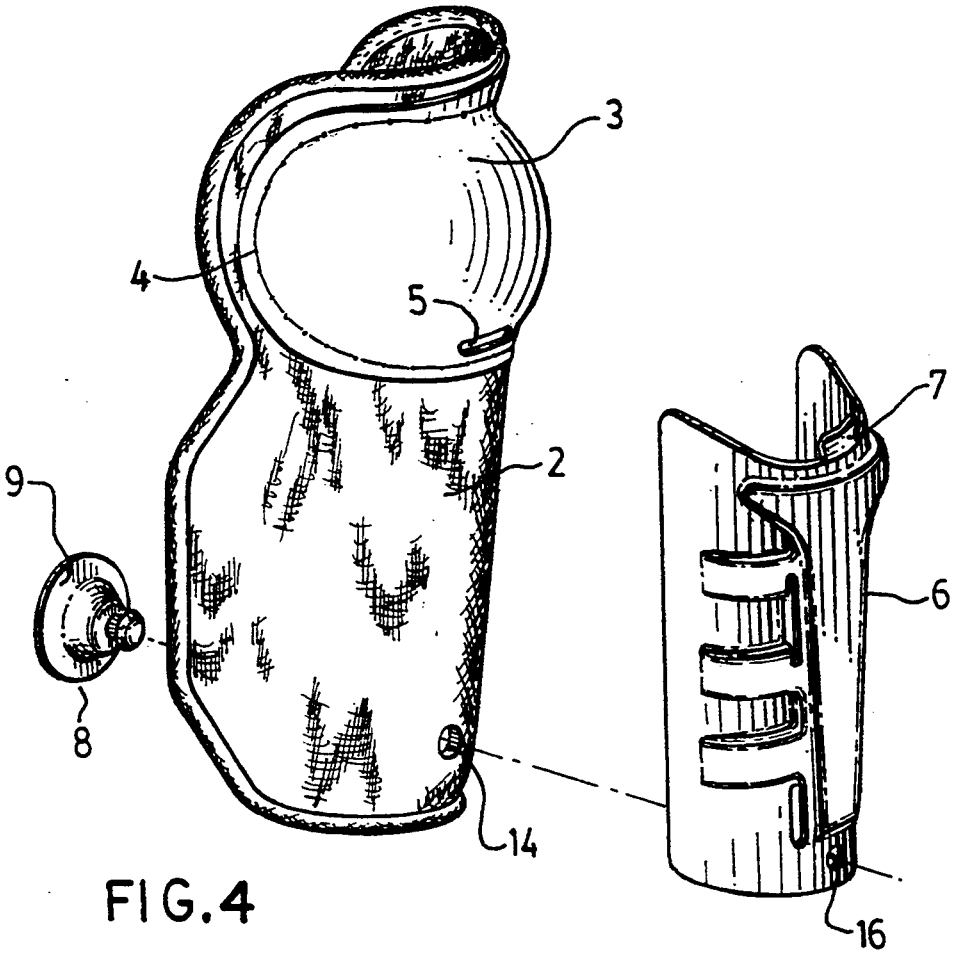
FIG. 4 is an exploded perspective of a shin pad, as a typical example of the use of the fastener.

Referring first to FIG. 4, showing a shin pad as an example of one use of the fastener, the shin pad includes an elongated flexible lining 2 (of foam, for example), and a rigid or semi-rigid knee shield 3 secured to the lining by any suitable means, such as sewing 4. A lower aspect of the knee shield has a generally central lateral slot 5 therein. A rigid or semi-rigid shin shield 6 is provided with a tab 7 projecting from the upper end thereof, for insertion in the slot, thereby locating the upper end of the shin shield against the lining. The lower portion of the shin shield is secured against the lining by the fastener 8 of the present invention, which has a post portion which passes through holes 14 and 16 in the lining and shin shield respectively.

Figure 2:
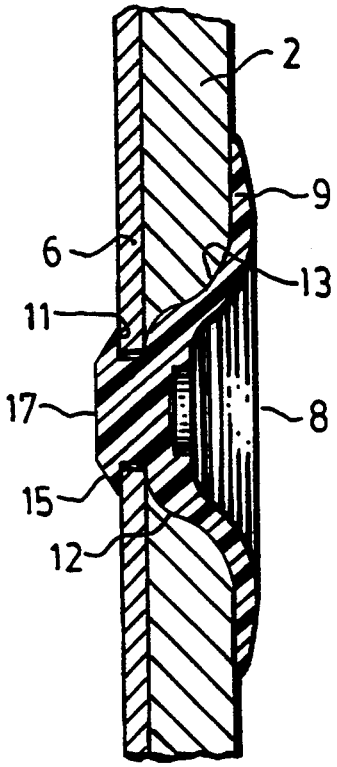
FIG. 2 is a cross-section showing the fastener securing a soft lining to a hard shell.
Figure 1:
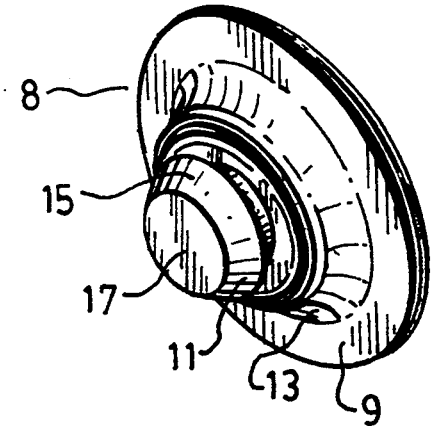
FIG. 1 is a perspective view of the preferred embodiment of the fastener.
Figure 3:
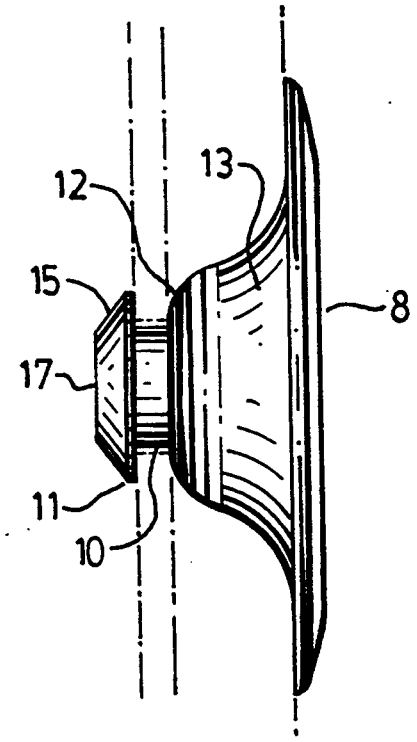
FIG. 3 is a side view of the fastener.

The fastener 8 as illustrated specifically in FIGS. 1–3, has a large, resilient base portion 9, which is on the inside of the lining 2, either flush with the surface of the lining, or possibly recessed somewhat by virtue of compression of the lining which the fastener may produce.

The fastener has a hollowed bell-shaped portion 13 leading from the base portion 9 to a shoulder 12. The post 10 projects outwardly therefrom, and has an annular flange 11 extending therefrom to catch the front of the shell 6. There is preferably a taper 15 from the annular flange to the end 17 of the fastener, to facilitate alignment and installation through the holes 14 and 16, and to provide slightly more flexibility for the flange so that it can be pressed through the hole 16.

The hole 14 preferably is approximately 8 to 8.5 mm in diameter, compared with a diameter of about 7.5 mm for the post 10 and about 12 mm for the annular flange 11.

No special tools are essential; the fastener can simply be inserted through the hole 14 in the lining, from the inside of the lining, and pressed through the hole 16 in the shell. The flange 11 is sufficiently flexible that it then pops out to engage the front of the shell. The flange serves to lock the shell in place, by sandwiching it between the flange 11 and the shoulder portion 12. The lining is held against the inside of the shell by the base portion 9. This simple insertion of the fastener can be done manually, or with a simple manual or automated tool, as desired.

The hole 14 typically may be somewhat larger than the hole 16, e.g. 12 to 15 mm in diameter. There is generally no need to taper the hole to match the shape of the bell-shaped portion 13, since the material of the lining 2 is generally sufficiently flexible and compressible to deform enough to accommodate the bell-shaped portion.

The use of the fasteners is thus extremely simple, thus minimizing the amount of labor required, as well as ensuring a safe and inexpensive product.

Safety is particularly enhanced by virtue of the fact that the bell-shaped portion 13, being somewhat flexible, will act as a shock absorber, to distribute a load placed on the shell over the full area of the base portion 9. Because the base portion 9 is quite soft and flexible, there is little or no possibility of injury or discomfort to the extent that might be possible if rivets or the like were used.

Preferably, the fastener is of an elastomeric thermoplastic material such as thermoplastic rubber, polyurethane or the like.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. An assembly comprising a soft lining, hard shell, and a fastener securing the soft lining and hard shell to each other, said fastener comprising a broad flexible generally planar base portion, a bell-shaped portion leading away from the plane of said base portion to a shoulder portion generally parallel to said base portion, and a post projecting farther from said shoulder portion and having an annular flange extending therefrom, where said hard shell is trapped between said shoulder portion and said annular flange and said soft lining is trapped between said base portion and said hard shell.

2. An assembly as recited in claim 1, where said annular flange has a taper therefrom to the end of said post.

* * * * *